United States Patent [19]

Östman

[11] Patent Number: 4,944,150

[45] Date of Patent: Jul. 31, 1990

[54] PFBC POWER PLANT

[75] Inventor: Sven-Olov Östman, Finspong, Sweden

[73] Assignee: ABB Stal AB, Sweden

[21] Appl. No.: 298,089

[22] Filed: Jan. 18, 1989

[30] Foreign Application Priority Data

Jan. 18, 1988 [SE] Sweden ..... 8800140

[51] Int. Cl.[5] ..... F02C 3/26; F02C 6/18

[52] U.S. Cl. ..... 60/39.182; 60/39.464; 122/4 D

[58] Field of Search ..... 60/39.464, 39.182; 110/263; 122/4 D; 431/170

[56] References Cited

U.S. PATENT DOCUMENTS 3,648,666 3/1972 Foldes et al. ..... 122/4 D 4,301,771 11/1981 Jukkola et al. ..... 122/4 D 4,498,286 2/1985 Branstrom et al. ..... 60/39.464

4,748,940 6/1988 Honig ..... 122/4 D

*Primary Examiner*—Louis J. Casaregola

*Attorney, Agent, or Firm*—Pollock, Vande Sande & Priddy

[57] ABSTRACT

A power plant burning a fuel at a pressure exceeding the atmospheric pressure includes a combustor formed with cooled walls which form a feed water preheater. A by-pass conduit with a control valve for draining feed water is connected to a feed water conduit between the feed water preheater (the combustor walls) and an evaporator in the combustor. This by-pass conduit may be connected to a feed water tank. At a very low load and in the case of a gas turbine trip, the necessary water flow for cooling the walls of the combustor may exceed the requirement of feed water to the evaporator. Under these operating conditions feed water may be drained off ahead of the evaporator through the by-pass conduit.

4 Claims, 2 Drawing Sheets

PFBC POWER PLANT

BACKGROUND ART

The invention relates to a PFBC power plant with a combustor operating at a pressure exceeding the atmospheric pressure and in which combustion gases drive a gas turbine which drives a compressor compressing combustion air. The walls of the combustor are water-cooled and form at least part of a feed water preheater for an evaporator and a superheater, placed in the combustor, for the generated steam (PFBC are the initial letters of the English expression Pressurized Fluidized Bed Combustion).

In a PFBC power plant, an optimum dimensioning of the feed water preheater, the evaporator and the superheater entails special problems at a very low load. It is advantageous to utilize the cooled walls of the combustor for preheating the feed water. These walls may form the entire feed water preheater or a part thereof. At a very low load, the necessary water flow for cooling of the combustor walls may exceed the water requirement in the evaporator of the plant. This means that too small a proportion of the supplied water is evaporated in the evaporator. The steam flow through the superheater may become insufficient so that its boiler tubes reach too high a temperature and are damaged. Upon a load drop out and a GT (gas turbine) trip, the large heat contents in the bed material of the combustor entail special problems. The water flow required for cooling the walls of the combustor is so great that the same flow through a subsequent evaporator results in very little steam being generated and in the tubes of the superheater not receiving a steam flow necessary for the cooling thereof, with an ensuing risk of these tubes being damaged.

SUMMARY OF THE INVENTION

In a power plant in which the combustor walls form at least part of a feed water preheater, a by-pass conduit with a controllable by-pass valve for feed water is connected to the connection between the feed water preheater and the evaporator in the combustor. By means of the valve in the by-pass conduit, the water flow to the evaporator is controlled such that, in the case of a load drop out or a low load, suitable water flow is achieved in the evaporator and the superheater.

BRIEF DESCRIPTION OF THE DRAWING

The invention will be described in greater detail with reference to the accompanying drawing, wherein.

DETAILED DESCRIPTION OF THE PREFERRED EMBODIMENT(S)

Figure 1:
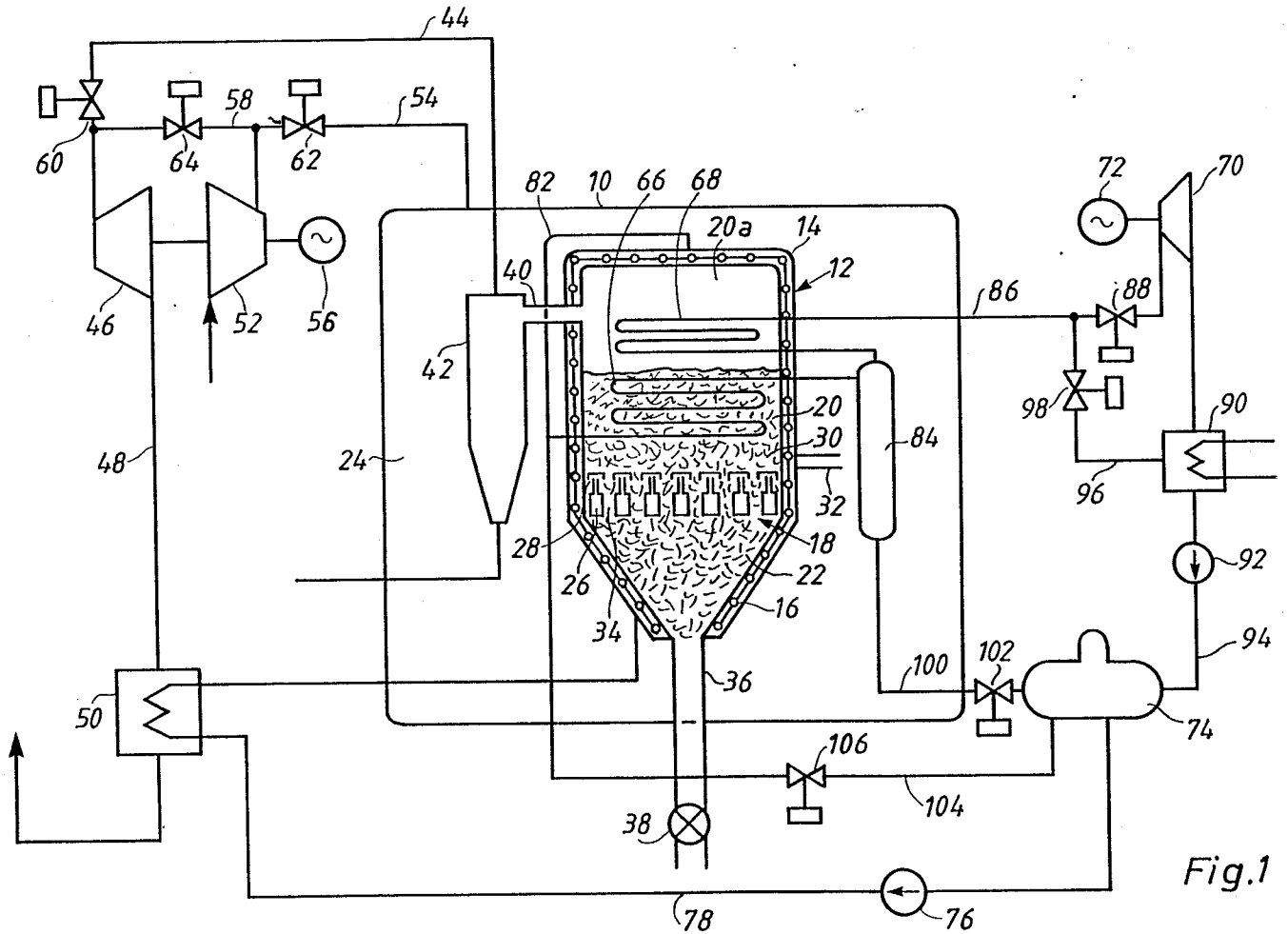
FIG. 1 shows very schematically a PFBC power plant according to the invention.

In the drawing, 10 designates a pressure vessel. A combustor 12 with cooled panel walls 14 containing cooling tubes 16 is arranged in the pressure vessel 10. A distributor 18 for combustion air divides the combustor 12 into a combustion space 20 and an ash chamber 22. The space 24 between the pressure vessel 10 and the combustor 12 contains compressed combustion air and communicates with the tubes 26 and the nozzles 28 of the distributor 18. Through these nozzles 28, the combustion space 20 is supplied with air for fluidization of the material in the bed 30 and combustion of fuel supplied through the conduit 32 from a fuel storage (not shown). Fresh bed material can be supplied together with the fuel. Between the air distributor tubes 26 there are gaps 34 through which consumed material and formed ashes in the bed 30 are able to flow from the combustion space 20 to the ash chamber 22. From the ash chamber 22, material is discharged through the conduit 36 and the rotary vane feeder 38.

The combustion gases generated during the combustion are collected in the freeboard of the combustion space 20 and are led through the conduit 40 to a cleaning plant, symbolized by the cyclone 42. Cleaned gas is led from there a conduit 44 to the gas turbine 46 and is then forwarded through a conduit 48 to the economizer 50 and finally to a chimney (not shown). The gas turbine 46 drives the compressor 52, which through the conduit 54 feeds the space 24 with compressed combustion air, and a generator 56 which can also be used as starter motor. Between the conduits 44 and 54 there is a short-circuit conduit 58. Valves 60, 62, 64 are provided in the conduits 44, 54, 58. In operation, the valves 60 and 62 are open and the valve 64 is closed. In the event of an operational disturbance resulting in a load drop out and a gas turbine trip, the valve 64 in the short-circuit conduit 58 is opened and the valves 60 and 62 are closed.

Figure 2:
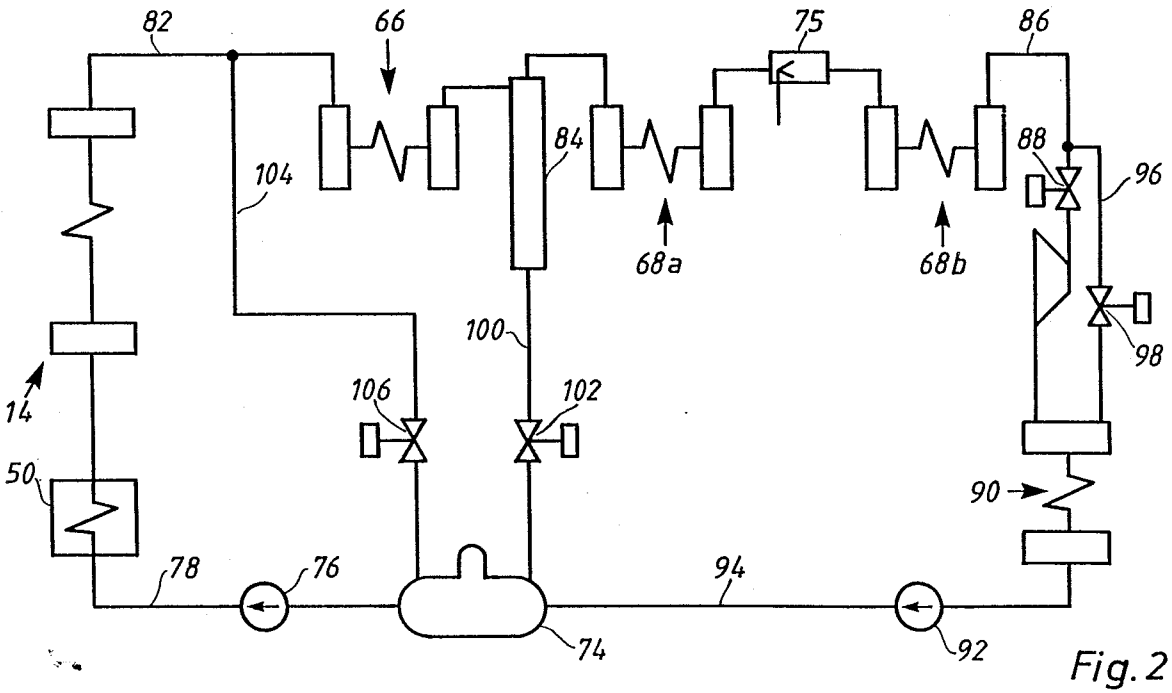
FIG. 2 shows a block diagram of such a plant.

The combustion space 20 of the combustor 12 comprises an evaporator 66 and a superheater 68. The evaporator 66 generates steam for a steam turbine 70 and cools the bed 30. The superheater 68 superheats the steam. The turbine 70 drives a generator 72. As shown by the block diagram in FIG. 2, the superheater 68 may be divided into a first part **68*a* and a second part 68*b*. A water injection device 75 for controlling the steam temperature may be provided between the parts 68*a* and 68*b***.

Water from a feed water tank 74 is pumped by a pump 76 through the conduit 78, the economizer 50 and the conduit 80 to the tubes 16 of the combustor wall 14, which tubes form a feed water preheater. The feed water, heated in the tubes 16 of the wall 14, is forwarded to the evaporator 66 through the conduit 82. Between the evaporator 66 and the superheater 68 there is a water separator 84. From the superheater 68, the steam is passed through the conduit 86 with the control valve 88 to the turbine 70. Steam from the turbine 70 is led to the condenser 90. The condensate is pumped by the pump 92 in the conduit 94 to the feed water tank 74. Between the steam conduit 86 and the condenser 90 there is a by-pass conduit 96 with a valve 98 through which steam can be dumped to the condenser 90 upon drop out of the load of the generator 72 and closing of the steam control valve 88. The water separator 84 is connected to the feed water tank 74, by means of the conduit 100 with the control valve 102, for drainage of water that has been separated. A conduit 104 with a control valve 106 connects the connection conduit 82 for preheated feed water from the tubes 16 of the combustor wall 14 to the evaporator 66. A number of transducers for measuring temperatures, water flows, steam flows, and the like, and the operating devices of valves included in the plant are connected to signal processing and control equipment (not shown).

In the event of operational disturbance resulting in a load drop out which causes a turbine trip, control measures are taken which reduce the energy development in the combustor 12. The fuel supply is interrupted, the bed depth is lowered, the air flow is reduced, and nitrogen gas can be supplied, etc. This means that the heat absorption in the evaporator 66 is reduced. The necessary water flow for cooling the combustor walls 14 is not reduced at the same rate and to the same extent. Water flow which prevents partial boiling and steam generation in the combustor wall 14 results in the steam generation in the evaporator 66 ceasing. The necessary cooling of the combustor walls 14 and the sufficient steam generation in the evaporator 66 are obtained by draining feed water, which has been heated in the walls 14, from the connection conduit 82 through the by-pass conduit 104 with the control valve 106. Also, in case of low load operation, a suitable balance between the water flow for cooling the combustor walls 14 and the water flow in the evaporator 66 and the steam flow through the evaporator 68 can be attained by drainage of feed water through the conduit 104 and the valve 106 to the feed water tank 74. Upon a gas turbine trip, up to about 60% of the water flow in the combustor walls 14 is drained via the by-pass conduit 104.

I claim:

1. A power plant burning a fuel at a pressure considerably exceeding the atmospheric pressure in a fluidized bed comprising:

a combustor with water-cooled walls which form a feed water preheater;

an evaporator provided within said combustor and having tubes which absorb heat from the fluidized bed and cool said bed;

at least one superheater arranged in said combustor;

a drain conduit connected to a feed water conduit between the preheater wall and the evaporator; and a drain valve provided in said drain conduit for draining part of the feed water flow, thus maintaining the generation of steam in the evaporator substantially under all operating conditions and in case of a load drop out.

2. A power plant according to claim 1, wherein a water separator is provided between the evaporator and the superheater.

3. A power plant according to claim 1, wherein the combustor is connected to a gas turbine which drives a compressor which compresses combustion air.

4. A power plant according to claim 1, wherein the combustor is enclosed within a pressure vessel and surrounded by compressed combustion air which is generated by said compressor and is supplied to a space between the pressure vessel and the combustor.

* * * * *